US005783807A

United States Patent [19]

Uehashi et al.

[11] Patent Number: 5,783,807

[45] Date of Patent: Jul. 21, 1998

[54] COOKING DEVICE FOR APPROPRIATELY PROCESSING PRE-COOKED FROZEN FOOD

[75] Inventors: Hiroyuki Uehashi, Koka-gun; Kazuko Tanaka, Yasu-gun, both of Japan

[73] Assignee: Sanyo Electric Co., Ltd., Moriguchi, Japan

[21] Appl. No.: 793,925

[22] PCT Filed: Jul. 25, 1996

[86] PCT No.: PCT/JP96/02087

§ 371 Date: Mar. 20, 1997

§ 102(e) Date: Mar. 20, 1997

[87] PCT Pub. No.: WO97/05429

PCT Pub. Date: Feb. 13, 1997

[30] Foreign Application Priority Data

Jul. 25, 1995 [JP] Japan ..... 7-189089

[51] Int. Cl.[6] ..... H05B 6/68

[52] U.S. Cl. ..... 219/685; 219/703; 219/705; 219/707; 219/710; 219/719; 99/325

[58] Field of Search ..... 219/704, 703, 219/705, 707, 710, 711, 719, 685, 757, 681; 99/325, DIG. 14

[56] References Cited

U.S. PATENT DOCUMENTS

| | | | |
|---|---|---|---|
| 4,481,394 | 11/1984 | Tanabe | 219/685 |
| 4,874,928 | 10/1989 | Kasai | 219/705 |
| 5,155,339 | 10/1992 | An | 219/707 |
| 5,367,145 | 11/1994 | Takagi | 219/710 |
| 5,464,967 | 11/1995 | Gong | 219/707 |

FOREIGN PATENT DOCUMENTS

| | | |
|---|---|---|
| 58-13934 | 1/1983 | Japan . |
| 61-69708 | 5/1986 | Japan . |
| 63-172830 | 7/1988 | Japan . |
| 64-19230 | 1/1989 | Japan . |
| 4-225727 | 8/1992 | Japan . |
| 5-205867 | 8/1993 | Japan . |

*Primary Examiner*—Philip H. Leung

*Attorney, Agent, or Firm*—Armstrong, Westerman, Hattori, McLeland, & Naughton

[57] ABSTRACT

After the initial temperature T0 of a heating chamber is sensed (S34), heating by microwaves is conducted until the sensor output of a humidity sensor exhibits a prescribed humidity change amount of 1.0 V (S35–S39). Then, an additional time period is operated based on initial temperature T0 and a time period passed for the elevation of 1.0 V (S40–S42, S50). Heating by microwaves is conducted for the additional time period (S43, S51), and then heating by a heater is conducted. As a result, the moisture included in the food is evaporated and finished crisp. In other words frozen precooked food may be thawed and cooked into a tasty state.

9 Claims, 16 Drawing Sheets

COOKING DEVICE FOR APPROPRIATELY PROCESSING PRE-COOKED FROZEN FOOD

TECHNICAL FIELD

The present invention relates generally to cooking devices capable of microwave-heating and heating with a heater, and more particularly to a cooking device suitable for processing precooked food.

BACKGROUND ART

A cooking device of interest to the present invention is disclosed by Japanese Patent Laying-Open No. 4-225727. According to the patent application, the cooking device includes a heating chamber for accommodating food to cook, a microwave heater and a heater for heating food placed in the heating chamber, a temperature sensor provided on the surface of the wall of the heating chamber for sensing the temperature within the heating chamber, an exhaust temperature sensor provided at an exhaust portion for letting out the atmosphere of the heating chamber, a humidity sensor for sensing the humidity within the heating chamber and a controller for controlling the entire cooking device. By the function of the controller, the microwave heater heats food until the output change amount of the humidity sensor reaches a prescribed value after starting heating, and then the heater heats the food for a calculated time period corresponding to the temperature change amount of the exhaust temperature sensor and heating time until the amount of humidity change reaches a prescribed value after starting heating.

Generally, food is heated by microwaves until the change amount of the humidity sensor reaches a prescribed value, and then the food is finished cooking by evaporating moisture using the heater. The humidity sensor however has a limited sensitivity, and it would be difficult to detect the same condition as for various kinds of cooking. If the output of the humidity sensor is the same, the state of heating is not always the same.

In order to solve such a disadvantage, there is a method of continuing microwave-heating while steaming the food wrapped with plastic wrap with vapor generated on the food. According to the method, the finished food becomes damp and the look is also spoiled. Therefore, after heating food by microwave heating without using wrap, evaporating the food by heating with a heater such as electric heater in order to make the finished food crisp and look delicious.

Recently, consumers use more frozen precooked food such as frozen pilaf and frozen prefried food sold at convenience stores. These kinds of food are thawed, heated and then served at tables of households. The food often becomes damp and looks tasteless.

The above-described method is directed to solving such a disadvantage, but the method is still encountered with the following problem.

Among various kinds of frozen precooked food, each item of frozen prefried food has a small unit value, through which microwaves easily penetrate, and therefore, thawing and heating progress quickly. Meanwhile, it is hard for microwaves to penetrate to the center of food such as frozen pilaf and frozen grilled rice balls in a large lump, and therefore, heating of the center of the food progresses slowly.

Therefore, frozen pilaf and frozen grilled rice balls in a large lump are thawed starting from the surface portion in the progress of heating. As a result, the output of the humidity sensor changes as the heating of the surface of the food proceeds. If therefore, the change amount of the humidity sensor reaches a prescribed value, the center of the food is not thawed enough and not heated enough unlike the surface. If the food is subjected to following heating with the heater with its center still not heated enough, the thawing of the center proceeds by the heat emitted from the heater. The moisture generated by the thawing oozes onto the surface, and the surface of the food finished cooking becomes damp and tasteless.

It is therefore an object of the present invention to provide a cooking device capable of appropriately processing precooked food, which overcomes the disadvantage associated with such a conventional cooking device.

DISCLOSURE OF THE INVENTION

A cooking device according to the present invention includes a heating chamber for placing food, a microwave heater for heating the food in the heating chamber with microwaves, a heater for heating the food within the heating chamber, a temperature sensor for sensing the temperature within the heating chamber, a humidity sensor for sensing the humidity of the heating chamber, a controller making such a control that the microwave heating by the microwave heater is followed by heating by the heater, and a timer portion for counting time until the sensor output of the humidity sensor exhibits a prescribed humidity change from the start of heating. The controller controls the microwave heater to perform additional heating in response to the counting result of the timer and the temperature detected at the start of heating.

Since such additional heating is conducted by the microwave heater based on the time required for a prescribed humidity change and the temperature at the start of heating, the surface of food does not become damp by the moisture emitted from the center of the food not yet thawed. As a result, the thawed food may be cooked into a beautiful taste.

The controller preferably calculates an additional time period based on the result of counting by the timer and the temperature of the heating chamber at the start of heating which is detected by the temperature sensor.

The additional time period is calculated based on heating time until the humidity sensor exhibits a prescribed humidity change, the microwave heater heats the food for the additional time period, and therefore, the food is heated for an appropriate additional time period.

According to another aspect of the invention, the cooking device includes a heating chamber for placing food, a microwave heater for heating the food in the heating chamber, a heater for heating the food in the heating chamber, a temperature sensor for sensing the temperature in the heating chamber, a humidity sensor for sensing the humidity in the heating chamber, a first cooking course execution portion for executing a first cooking course of heating the food with the microwave heater until the output of humidity sensor exhibits a prescribed humidity change from the start of heating followed by heating by the heater, a second cooking course execution portion for executing a second cooking course of performing additional heating based on a temperature sensed by the temperature sensor at the start of heating and a time period until the sensor output of humidity sensor exhibits a prescribed humidity change from the start of heating between the heating by the microwave heater and the heating by the heater in the first cooking course, and a selection portion for selecting one of the first cooking course and the second cooking course.

Since the first cooking course or the second cooking course may be selected based on food to cook by heating, a cooking device capable of performing appropriate heating based on the kind of food is provided.

The selection portion preferably selects the first cooking course if the amount of humidity change sensed by the humidity sensor after a prescribed time period is passed from the start of heating is larger than a prescribed cooking determination value, and selects the second cooking course if the amount of humidity change is smaller than the cooking determination value.

Since the selection portion automatically selects a cooking course based on the amount of humidity change from the start of cooking to effect the first or second cooking course execution portion, appropriate heating may automatically be performed.

The cooking device more preferably includes an operation portion for instructing the start of cooking and selection of a cooking course, and the selection portion selects and effects the first cooking course execution portion or the second cooking course execution in response to an instruction from the operation portion.

Since the first or second cooking course execution portion is executed through the selecting portion in response to an instruction from the operation portion, the user may select a desired cooking course.

More preferably, the food is frozen precooked food.

Since appropriate heating is conducted to frozen precooked food, a cooking device capable of thawing such frozen precooked food into a good taste may be provided.

PREFERRED EMBODIMENTS FOR IMPLEMENTING THE INVENTION

The present invention will be more specifically described in conjunction with the accompanying drawings.

Figure 1:
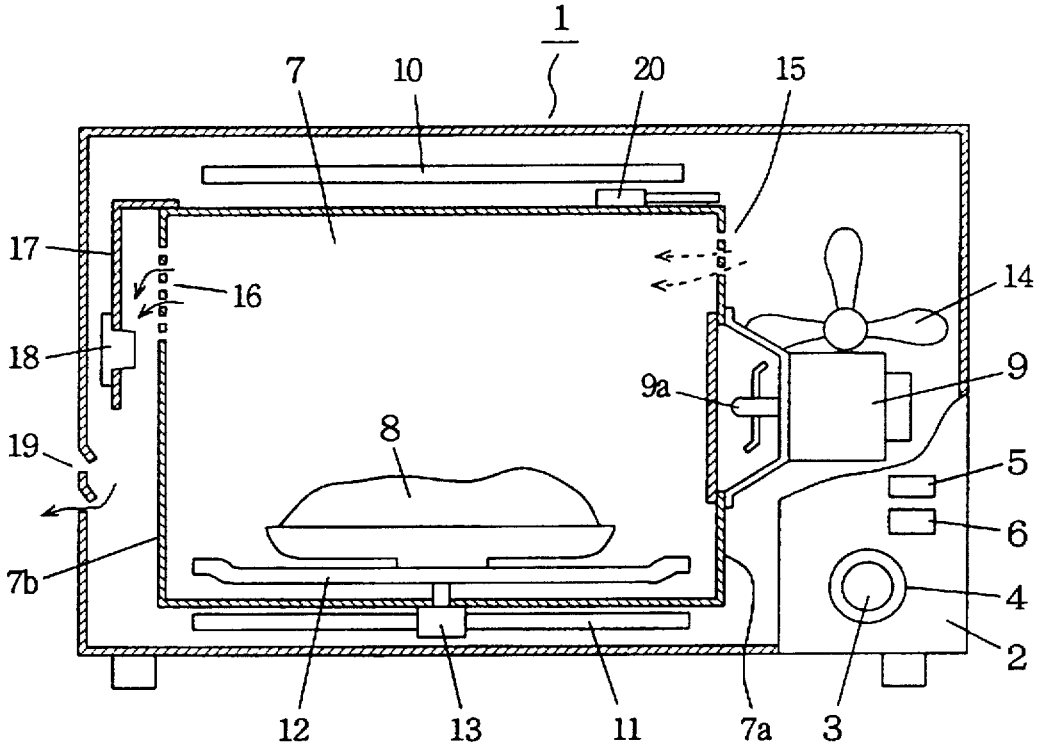
FIG. 1 is an overview showing a microwave oven according to one embodiment of the present invention.

Referring to FIG. 1, a microwave oven 1 having a function of oven-cooking according to one embodiment of the invention includes an operation portion 2 provided at the front surface of microwave oven 1. Operation portion 2 has a start key 3 functioning both to select a warming course and to instruct starting of cooking, a cooking selection dial 4 provided around start key 3 for selecting an automatic cooking menu by turning, a first key 5 for cooking frozen prefried food/pizzas among various kinds of frozen precooked food, and a second key 6 for cooking frozen pilaf (as well as frozen grilled rice ball). The first key 5 and second key 6 form the selection portion of the controller which will be described later.

Microwave oven 1 includes a heating chamber 7 for accommodating food 8, a magnetron 9 functioning as a microwave heater for heating food 8 in heating chamber 7 by microwaves radiated from an antenna 9*a*, an upper heater 10 mounted on the upper wall of heating chamber 7, a lower heater 11 mounted on the lower wall of heating chamber 7, a turn table 12 for turning food 8 placed thereon in heating chamber 7, and a turn table motor 13 for turning turn table 12. Upper heater 10 and lower heater 11 heat food 8. The heaters may be a convection type heater.

Microwave oven 1 is provided with a cooling fan 14, which lets in the air through the inlet 15 (not shown) of microwave oven 1 and cools the magnetron 9 and the controller which will be described later. Inlet 15 is provided at the sidewall 7*a* of heating chamber 7 on the side of cooling fan 14 and introduces cooling wind into heating chamber 7. An exhaust outlet 16 is provided at side wall 7*b* on the side opposite to side wall 7*a*. The direction in which the atmosphere from heating chambers 7 is exhausted from exhaust outlet 16 is changed downward by the function of an exhaust duct 17. Exhaust duct 17 is provided with a humidity sensor 18 for sensing the humidity of the atmosphere let out from heating chamber 7. An outer exhaust outlet 19 is provided at the side wall of microwave oven 1, and a thermistor 20 functioning as a temperature sensor is provided on the upper wall of the heating chamber 7.

Note that food 8 is placed in heating chamber 7 from the opening in the front and enclosed therein by a door (not shown) which opens/closes.

Figure 2:
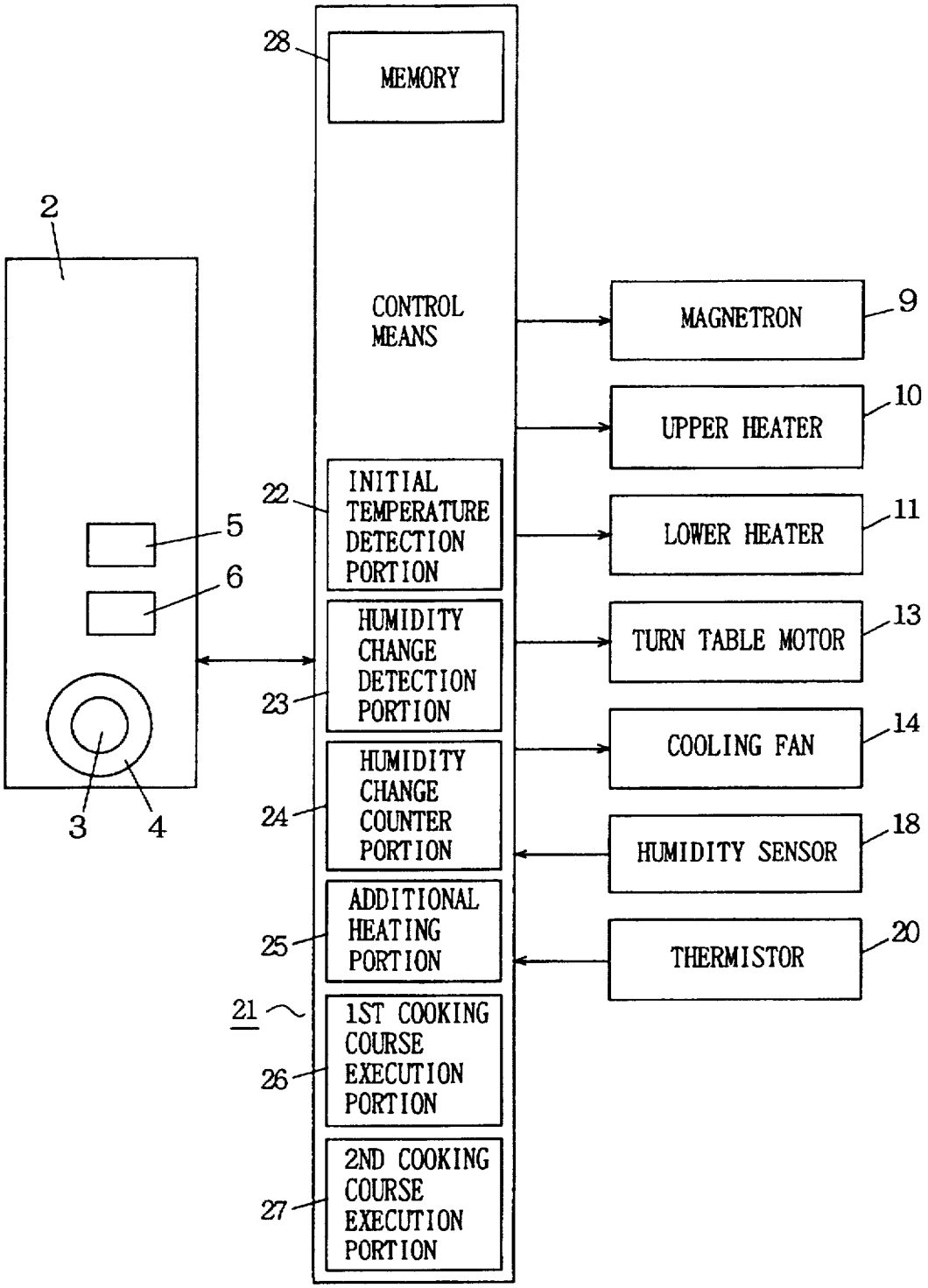
FIG. 2 is a control block diagram for the microwave oven.

FIG. 2 shows a controller 21 formed of a microcomputer. Controller 21 is connected with operation portion 2, magnetron 9, upper heater 10, lower heater 11, turn table motor 13, cooing fan motor 14, humidity sensor 18 and thermistor 20.

Figure 4:
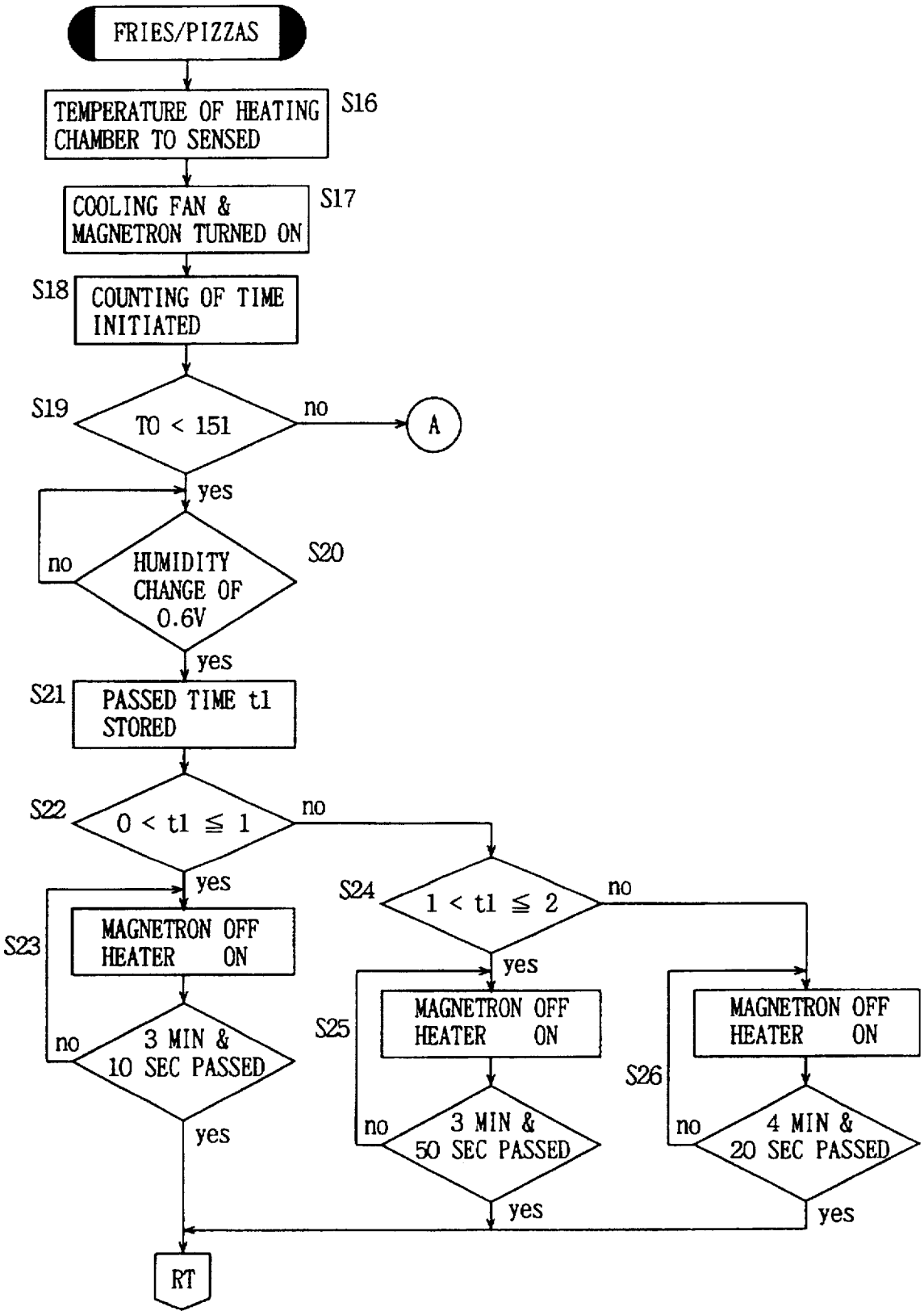
FIGS. 4 and 5 are flow charts showing the operations of cooking courses for fried food and pilafs.
Figure 5:
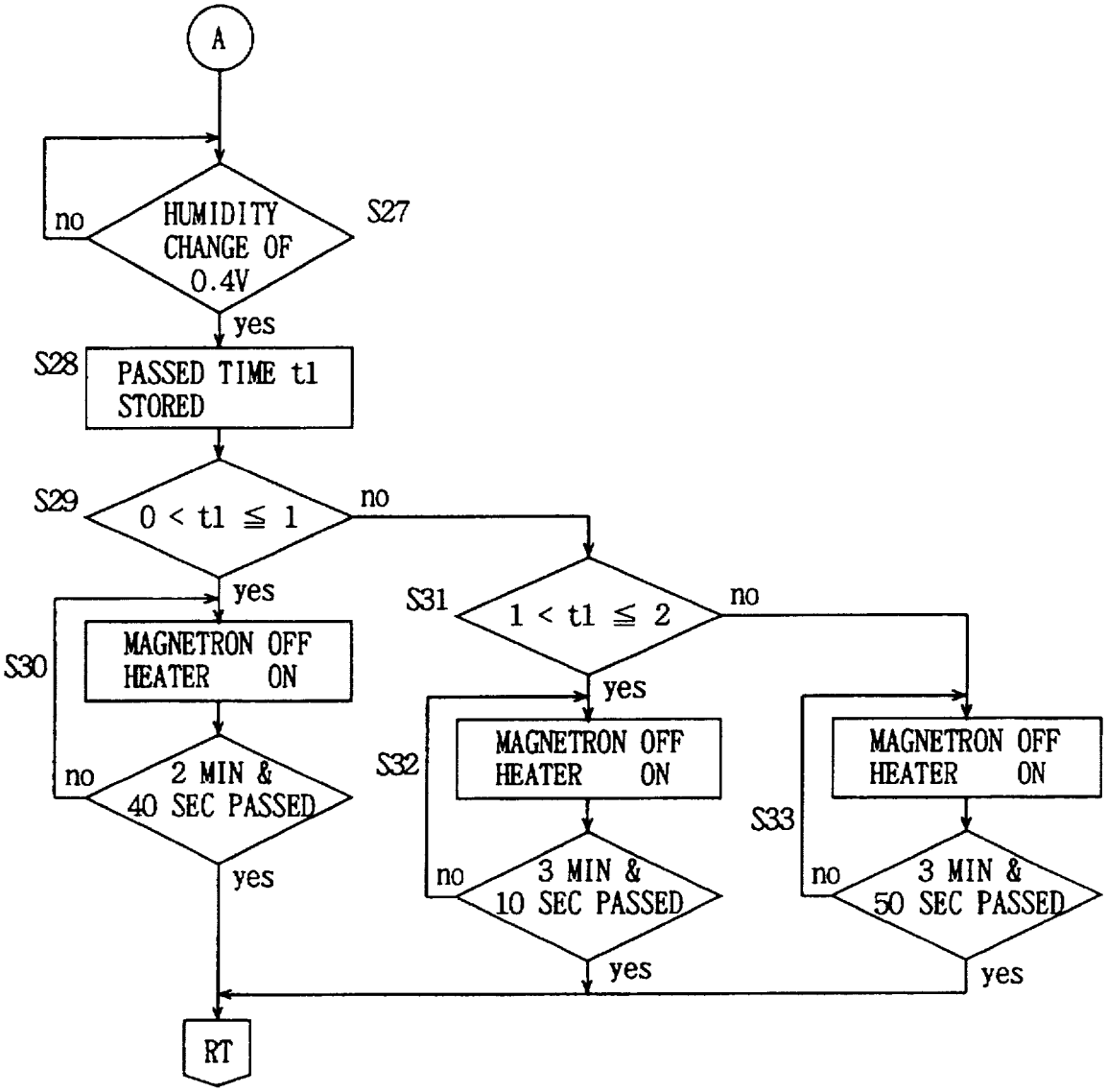
Figure 6:
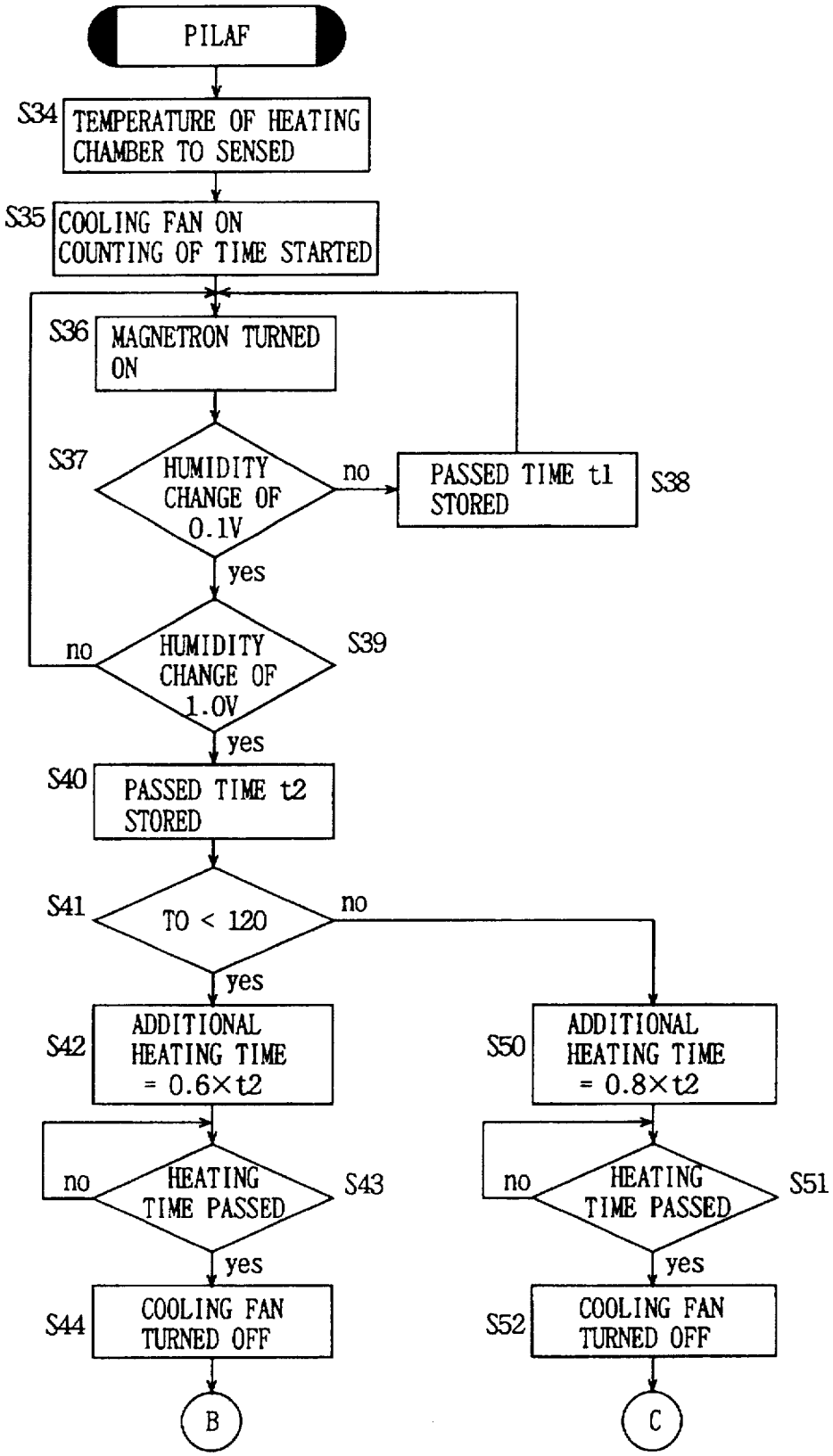
FIGS. 6 to 8 are flow charts showing the operation of cooking pilaf.
Figure 7:
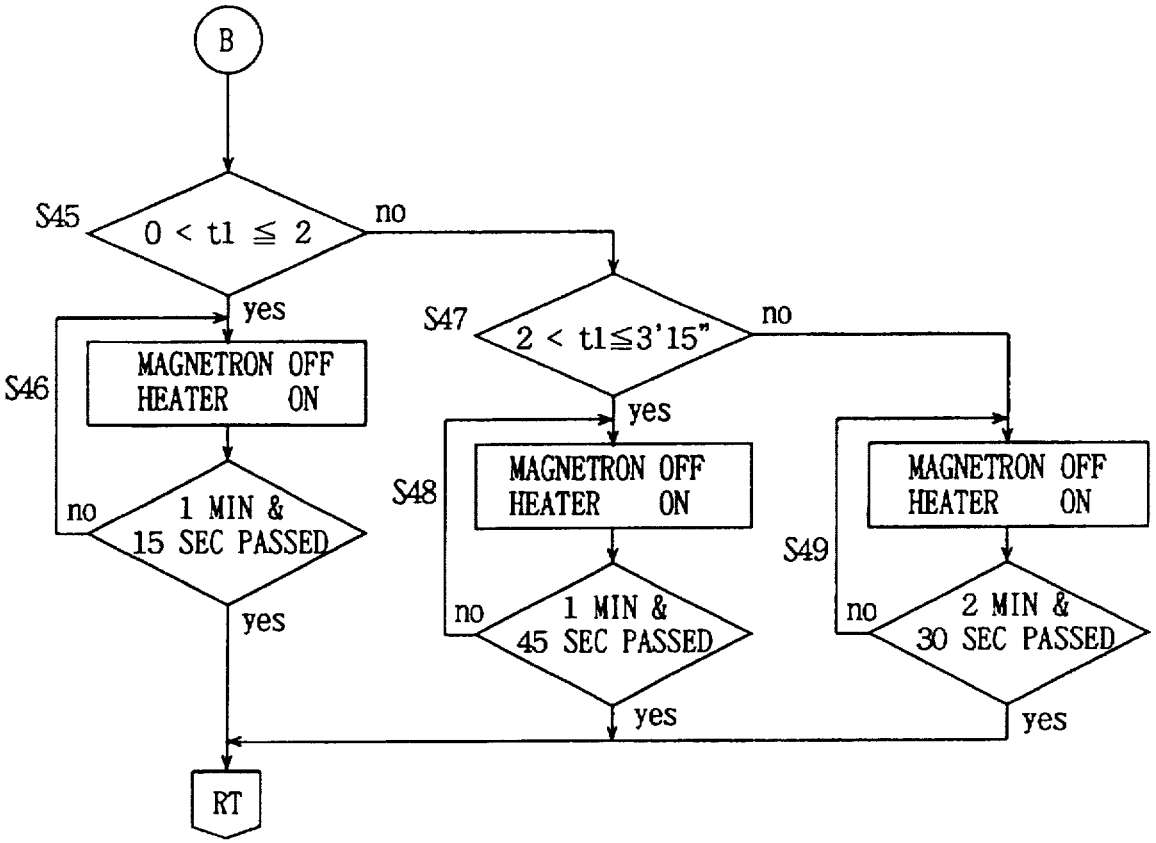
Figure 8:
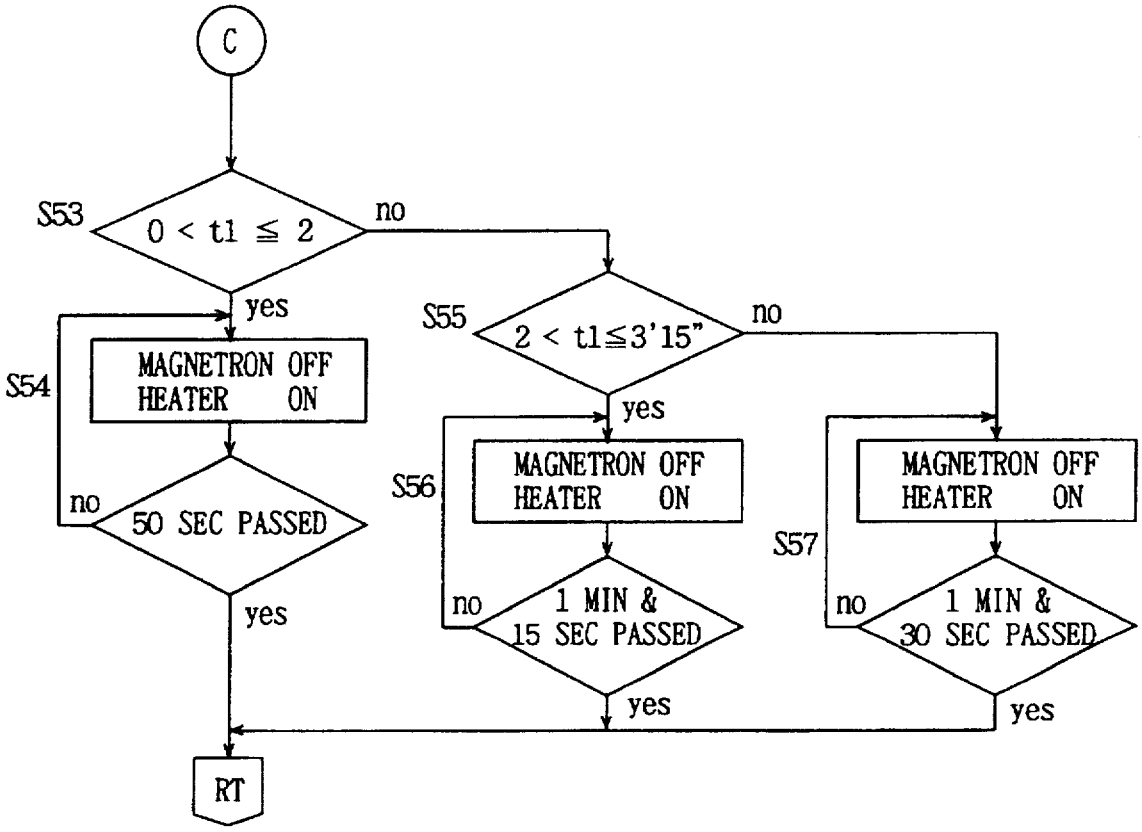

Controller 21 has an initial temperature sensing portion 22 for sensing temperature T0 in heating chamber 7 at the start of heating using thermistor 20, a humidity change detection portion 23 for detecting a humidity change from the start of heating based on the sensor output of humidity sensor 18, a humidity change timer portion 24 functioning as a timer for counting a time period until a prescribed humidity change from the start of heating is obtained at humidity change detection portion 23, an additional heating portion 25 for executing additional heating by microwave heating based on an output from humidity change timer portion 24 and on temperature T0 detected by initial temperature detection portion 22, a first cooking course execution portion 26 for executing cooking as shown in FIGS. 4 and 5 which will be described later in response to an operation of first key 5, a second cooking course execution portion for executing cooking as shown in FIGS. 6 to 8 which will be described later in response to an operation of second key 6, and a memory 28.

Humidity sensor 18 is formed of open type and close type thermistors having the same temperature characteristics, and humidity is calculated based on the difference between temperatures detected by these two thermistors as a sensor output.

Now referring to FIGS. 3, the operation of the cooking device according to the present invention will be described.

In step S1, a cooking flag (denoted as COOKING in FIGS. 3 to 8) and a menu flag (denoted as MENU in FIGS. 3 to 8) are reset to 0 in an initialization operation. In steps S2 to S5, the operated key is determined.

More specifically, in step S2, it is determined if first key 5 was operated, and if it is determined that the key was operated, the cooking flag is set to 1 in step S6. In step S3, it is determined if second key 6 was operated, and if it is determined that the key was operated, the cooking flag is set to 2 in step S7. In step S4, it is determined if the automatic menu was selected by cooking selection dial 4, and if it is determined that the menu was selected, the menu flag is set to 1 in step S8. In step S5, it is determined if start key 3 was operated, and if it is determined that the key was operated, the operation transits to the following step, and if not, the operation returns to step S2. Note that if it is determined in steps S2 to S5 that no operation was made, the processing transits to the following step in order.

If it is determined in step S5 that start key 3 was operated, in the following steps S9 to S11, how each flag is set is determined in order to select a method of controlling.

More specifically, it is determined if the cooking flag is set to 1 in step S9, and if the flag is set to 1, the frozen precooked food heating course for fried food/pizzas is executed in the first cooking course execution portion 26 of controller 21. If it is determined in step S9 that the flag is not set to 1, the processing transits to step S10, and it is determined if the cooking flag is set to 2, and if the flag is set to 2, in step S13 the frozen precooked food heating course for pilaf is executed in the second cooking course execution portion 27.

If it is determined in step S10 that the cooking flag is not set to 2, it is determined in step S11 if the menu flag is set to 1, and if the menu flag is set to 1, in step S14 a heating course for the cooking menu selected by selection dial 4 is executed. If it is determined in step S11 that the menu flag is not set to 1, it is determined that only start key 3 was operated and the warming heating course is executed in step S15. If execution of any of the courses from steps S12 to S15 completes, the processing returns to step S1, executes an initialization operation and waits until the next operation.

Figure 3:
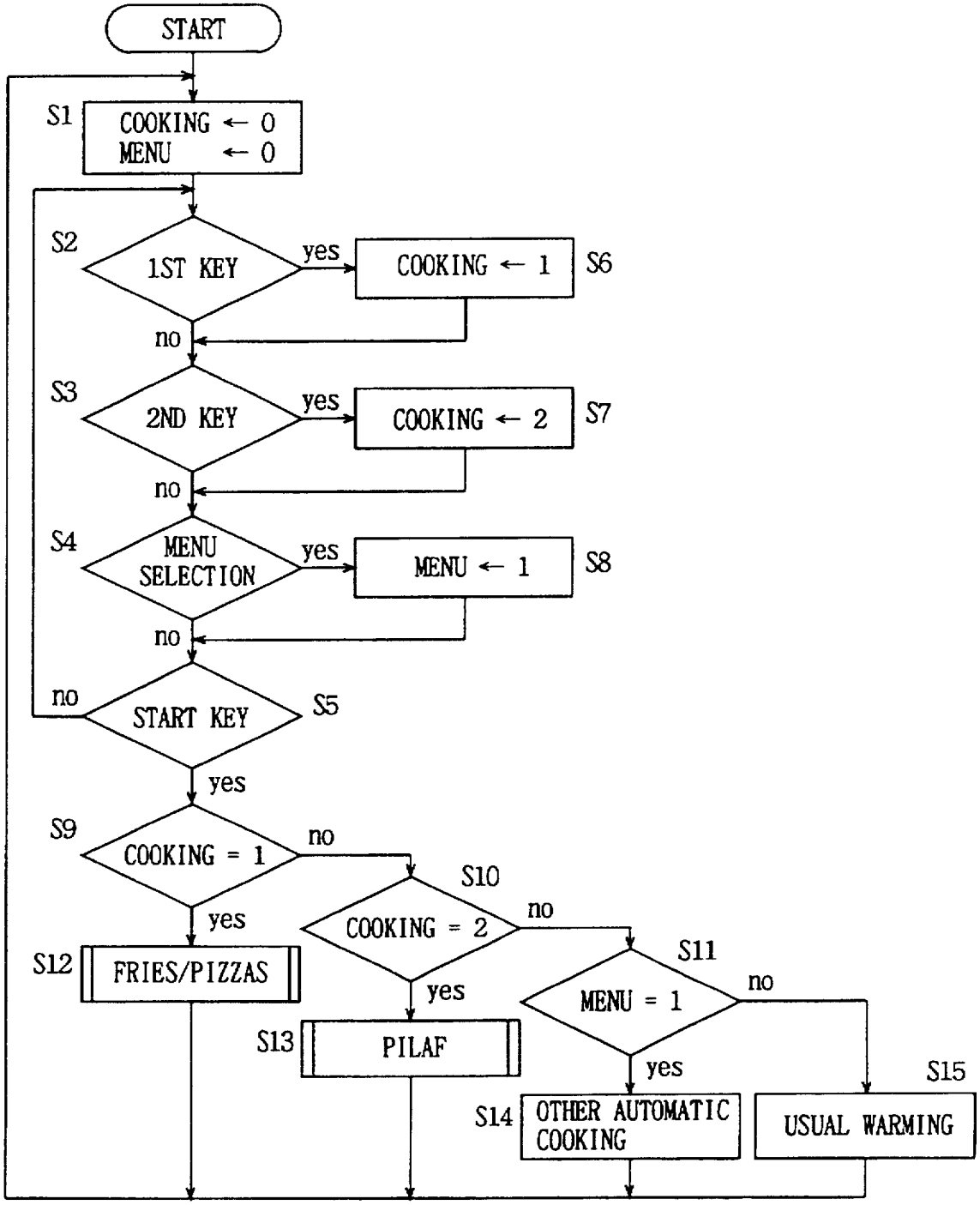
FIG. 3 is a flow chart showing the operation of a cooking device according to the present invention.

Now, a description will follow on the operation of the frozen precooked food heating course for fried food/pizzas described in step S12 shown in FIG. 3. In step S12, initial temperature T0 in heating chamber 7 is detected in step S16, in other words the temperature in the heating chamber 7 is sensed by initial temperature detection potion 22 using the thermistor 20. In step S17, magnetron 9 and cooling fan 14 are driven. In step S18, the humidity change timer portion 24 of controller 21 starts counting passage of time from the start of heating. In step S19, it is determined if initial temperature T0 is lower than 151° C.

If it is determined that the temperature is lower than 151° C. in step S19, in step S20 humidity change detection portion 23 determines if the sensor output of humidity sensor 18 has changed by 0.6 V from the start of heating, in other words the humidity change has reached 0.6 V. If it is determined in step S20 that the change of 0.6 V is reached, in step S21 passage of time t1 counted by humidity change timer portion 24 is stored in the memory 28 of controller 21.

It is determined in step S22 if the above-described time t1 is 1 minute or shorter. If passage of time t1 is equal to or shorter than 1 minute, the operation of magnetron 9 is stopped in step S23 and upper heater 10 and lower heater 11 are turned on for 3 minutes and 10 seconds, thus completing the heating.

If passage of time t1 is equal to or longer than 1 minute, it is determined in step S24 if it is in the range from one minute to two minutes, and for the period equal to or less than two minutes, the operation of magnetron 9 is stopped in step S25, and upper heater 10 and lower heater 11 are turned on for 3 minutes and 50 seconds, and then heating with the heaters is completed.

If passage of time t1 is longer than two minutes, the operation of magnetron 9 is stopped in step S26, upper heater 10 and lower heater 11 are turned on for 4 minutes and 20 seconds, thus completing heating with the heaters.

If it is determined in step S19 that it is equal to or higher than 151° C., it is determined in step S27 if the output of humidity sensor 18 has changed by 0.4 V from the start of heating. If it is determined in step S27 that the change by 0.4 V was made, in step S28 a time period t1 counted by humidity change counter portion 24 is stored in the memory 28 of controller 21. Herein, the change amount of 0.4 V corresponds to a prescribed humidity change amount.

In step 29, it is determined if the above-described time period t1 is equal to or shorter than 1 minute. If t1 is equal to or shorter than 1 minute, in step S30 the operation of magnetron 9 is stopped, upper heater 10 and lower heater 11 are turned on for 2 minutes and 40 seconds, thus completing heating by the heaters.

If time period t1 exceeds 1 minute, it is determined in step S31 if the time period exceeds one minute and equal to or shorter than to 2 minutes, and if it is equal to or shorter than 2 minutes, in step S32 the operation of magnetron 9 is stopped, upper heater 10 and lower heater 11 are turned on for 3 minutes and 10 seconds, thus completing heating by the heaters.

If time period t1 exceeds 2 minutes, the operation of magnetron 9 is stopped in step 33, upper heater 10 and lower heater 11 are turned on for 3 minutes and 35 seconds, thus completing heating by the heaters.

Once execution of any of the courses according to steps S23, S25, S26, S30, S32 and S33 completes, the processing in the precooked food heating course for fried food/pizzas in steps S12 completes.

Now, operations in the precooked food heating course for pilaf shown in step S13 in FIG. 3 will be described in conjunction with FIGS. 6 to 8.

If the operation transits to step S13, in step S34 the initial temperature T0 of heating chamber 7 is detected first. More specifically, the temperature in heating chamber 7 is detected by initial temperature detection portion 22, using thermistor 20. In steps S35, cooling fan 14 is driven. At the time, the counting operation of humidity change counter portion 24 in controller 21 for counting passage of time from the start of heating is initiated. In step S36, magnetron 9 is driven. In step S37, it is determined if the humidity at humidity sensor 18 has changed by 0.1 V from the start of heating, using humidity change detection portion 23. If it is determined in step S37 that the change of 0.1 V was made, passage of time t1 at humidity change counter portion 24 is stored in memory 28 in step S38.

Then, heating by microwaves is continued until it is determined in step S39 that the output of humidity sensor 18 has changed by 1.0 V from the start of heating. If it is determined by humidity change detection portion 23 in step S39 that the sensor output has changed by 1.0 V, passage of time t2 from the start of heating is stored in memory 28 in step S40, and the operation transits to the next step. Herein the change amount of 1.0 V corresponds to a prescribed humidity change amount.

It is determined in step S41 if initial temperature T0 is lower than 120° C. If it is determined in step S41 that the temperature is lower than 120° C., in step S42 time produced by multiplying time t2 by 0.6 is operated to produce an additional heating time period, using additional heating portion 25. In step S43, counting of the additional time period by additional heating portion 25 is started and the operation transits to the following step if the heating time is passed. In this additional heating, magnetron 9, continues to be driven in order to execute heating by microwaves.

Step S44 stops driving cooling fan 14. It is determined in step S45 if the above-described passage of time t1 is equal to or shorter than 2 minutes. If time t1 is equal to or shorter than 2 minutes, the operation of magnetron 9 is stopped in step S46, upper heater 10 and lower heater 11 are turned on for 1 minute and 15 seconds, and then the heating by the heaters completes.

If time period t1 is longer than 2 minutes, it is determined in step S47 if the time period is longer than 2 minutes and equal to or shorter than 3 minutes and 15 seconds. If it is equal to or shorter than 3 minutes and 15 seconds, the operation of magnetron 9 is stopped in step S48, upper heater 10 and lower heater 11 are turned on for 1 minute and 45 seconds, and then heating by the heaters completes.

If passage of time t1 is longer than 3 minutes and 15 seconds, the operation of magnetron 9 is stopped in step S49, upper heater 10 and lower heater 11 are turned on for 2 minutes and 30 seconds, and then heating by the heaters completes.

If it is determined in S41 that the temperature is not lower than 120° C., in other words equal to or higher than 120° C., in step S50 time produced by multiplying t2 by 0.8 is operated as an additional heating time period by additional heating portion 25. In step S51, counting of the additional heating time period by additional heating portion 25 is initiated, and the operation transits to the following steps after passage of the heating time period. The additional time period is provided to continue heating by microwaves by continuing to drive magnetron 9.

In step S52, cooling fan 14 is stopped from driven. It is determined in step S53 if the above-described time t1 is equal to or shorter than 2 minutes. If t1 is equal to or shorter than 2 minutes, the operation of magnetron 9 is stopped in S54, upper heater 10 and lower heater 11 are turned on for 50 seconds, and then heating by the heaters completes.

If time t1 is longer than 2 minutes, it is determined in step S55 if the time period is longer than 2 minutes and equal to or shorter than 3 minutes and 15 seconds. If it is equal to or shorter than 3 minutes and 15 seconds, the operation of the magnetron 9 is stopped in S56, upper heater 10 and lower heater 11 are turned on for 1 minute and 15 seconds, and then heating by the heaters completes.

If time period t1 is longer than 3 minutes and 15 seconds, the operation of magnetron 9 is stopped in step S57, upper heater 10 and lower heater 11 are turned on for 1 minute 30 seconds, and then heating by the heaters completes.

Once execution of any of the courses according to steps S46, S48, S49, S54, S56, and S57 completes, the frozen precooked food heating course for pilaf in step S13 completes.

Now, the operation started by operating second key 6 will be described by illustrating specific examples. Herein, the temperature in heating chamber 7 is at 20° C.

After food 8 is placed in heating chamber 7, second key 6 is operated. Controller 21 determines the operation in steps S3, and the cooking flag is set to 2. When a user operates second key 6 and then start key 3, controller 21 determines in step S10 that the cooking flag is set to 2, and the cooking course according to step S13 is executed. According to the cooking course, initial temperature T0 in heating chamber is 7 is detected by thermistor 20. The temperature detected in this case is 20° C. as described above, then, cooling fan 14 and magnetron 9 are driven and it is determined in step S37 if the output of humidity sensor 18 detected by humidity change detection portion 23 has changed by 0.1 V.

Figure 9:
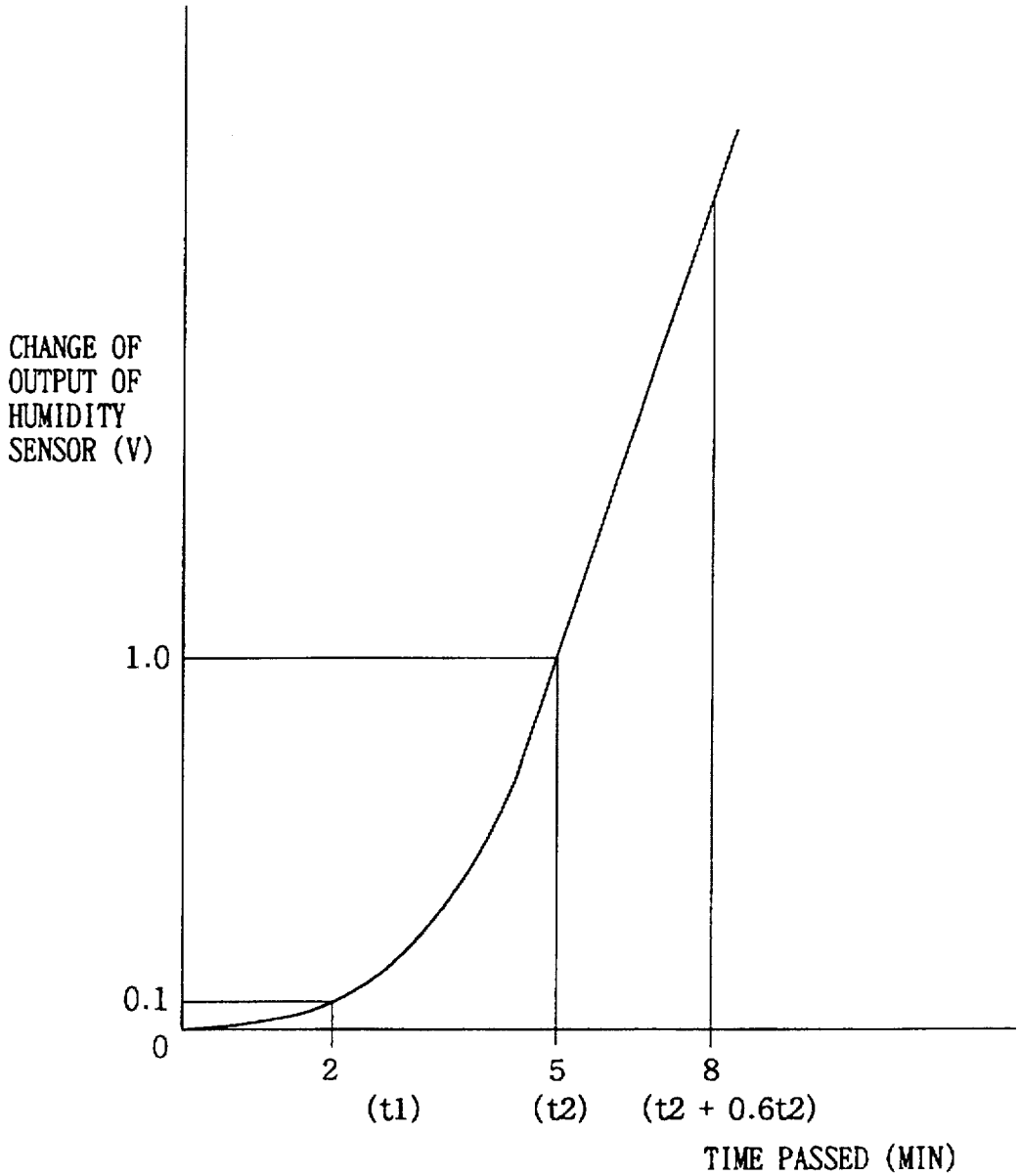
FIG. 9 is a graph showing the relation between the sensor output of a humidity sensor and passage of time.

At the time, the output of humidity sensor 18 elevates with passage of time from the start of heating as illustrated in FIG. 9. If the value is elevated to 0.1 V, time t1 is stored in memory 28 in step S38. Suppose that time period t1 is for example 2 minutes. If it is determined in step S39 that the output of humidity sensor 18 detected by humidity change detecting portion 23 has changed by 1.0 V, a time period t2 counted by humidity change counter portion 24 is stored in memory 28. Suppose that time period t2 is for example 5 minutes.

It is determined in step S41 that initial temperature t0 (20° C.) is lower than 120° C., and the operation transits to step S42. In step S42 an additional heating time period is operated by additional heating portion 25. More specifically, 5×0.6=3 minutes results. Then in step S43, counting of 3 minutes is initiated by additional heating portion 25, and the operation transits to step S44 after the counting completes. Note that during this additional heating time period, heating by the microwave continues.

If it is determined in step S43 that the additional heating time period is passed, cooling fan 14 is stopped, and the operation transits to step S45. Since time period t1 is set to 2 minutes as described above, it is determined in step S45 that the time period is equal to or shorter than 2 minutes. In step S46 magnetron 9 is turned off, and upper heater 10 and lower heater 11 are turned on. After heating by the heaters continues for 1 minutes 15 seconds, upper heater 10 and lower heater 11 are turned off, thus completing execution of the cooking course.

Another embodiment of the invention will be described in conjunction with FIGS. 10 to 16. In the figures, the same portions as those in FIGS. 1 and 2 are denoted with the same reference character and numerals, with description thereof being omitted.

Figure 10:
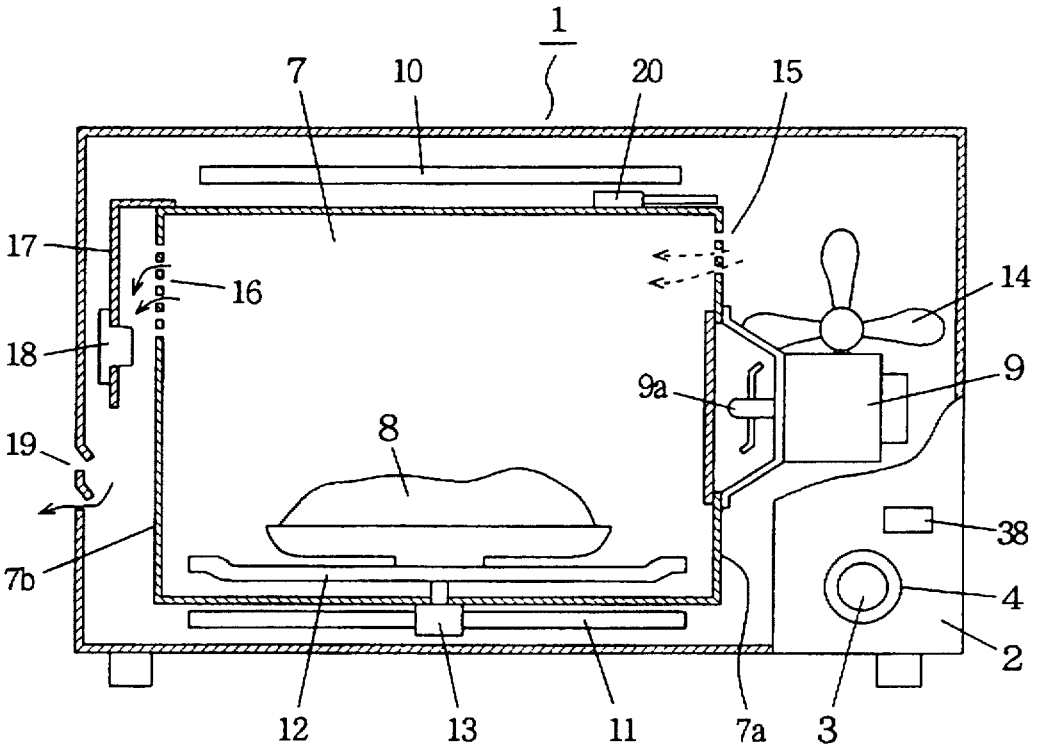
FIG. 10 is an overview showing a microwave oven according to another embodiment of the invention.
Figure 11:
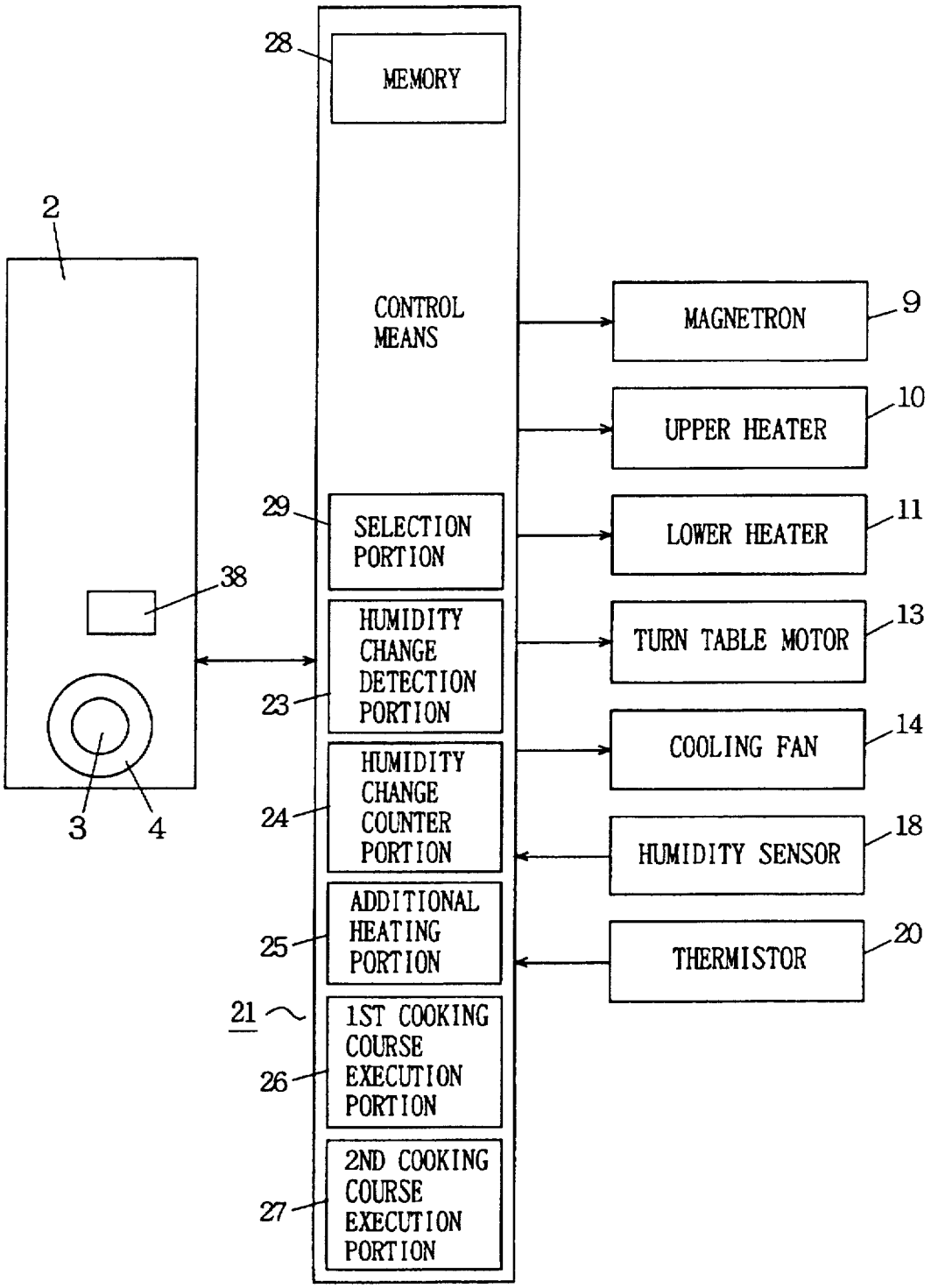
FIG. 11 is a control block diagram for a microwave oven according to another embodiment of the invention.
Figure 12:
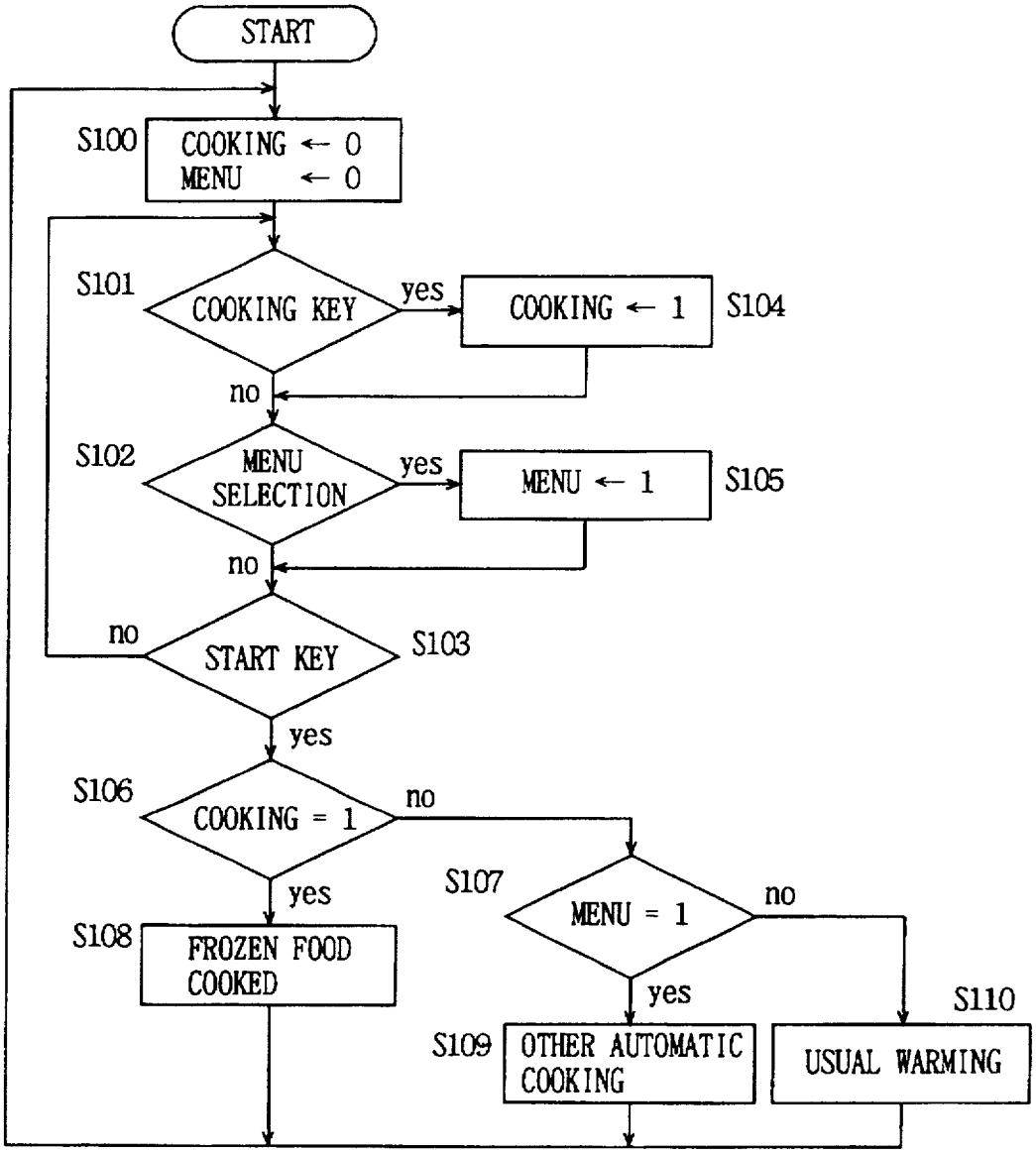
FIG. 12 is a flow chart for use in illustration of the operation of a microwave oven according to another embodiment of the invention.
Figure 13:
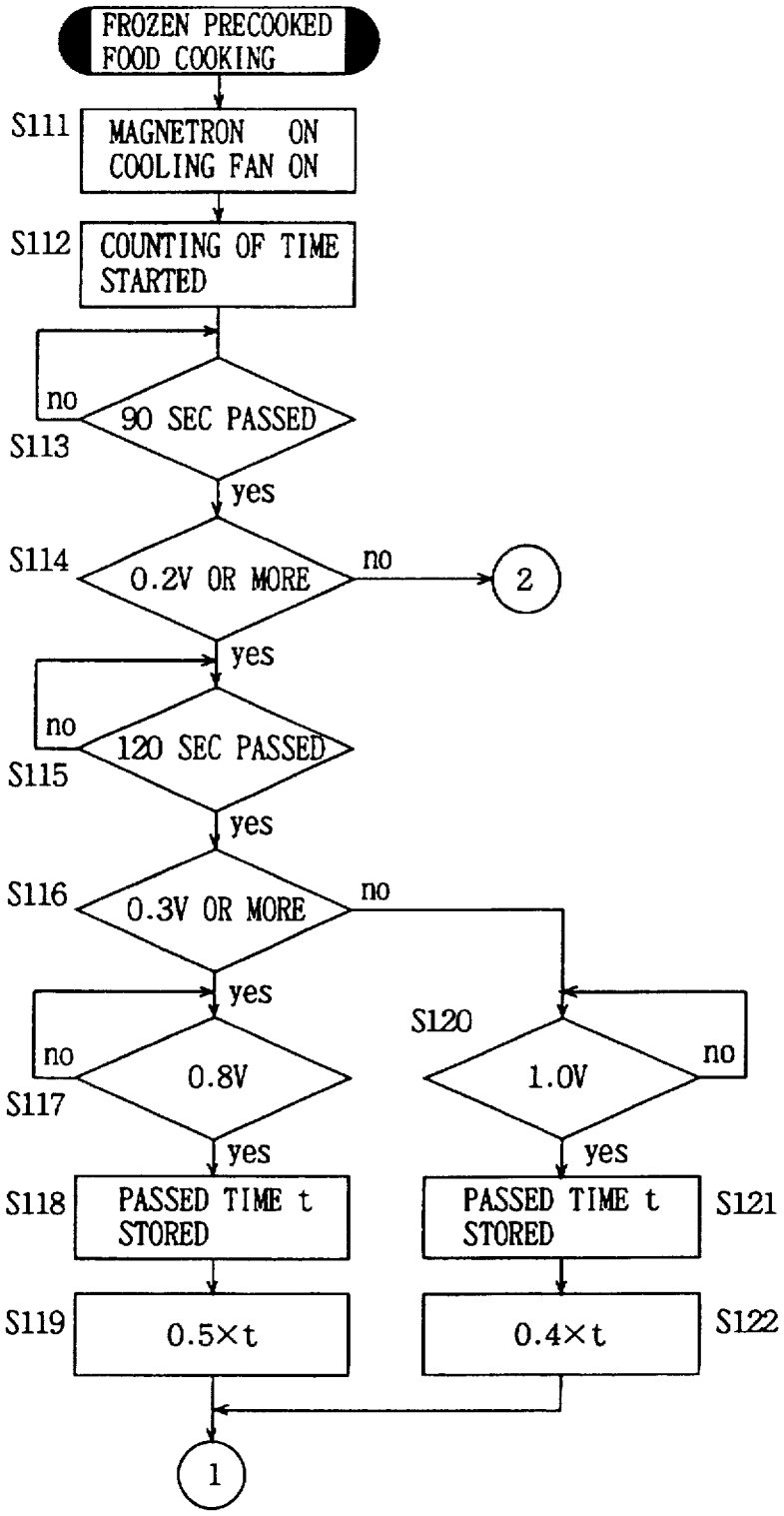
FIGS. 13 to 15 are flow chats for use in illustration of a precooked food cooking course shown in FIG. 12.
Figure 14:
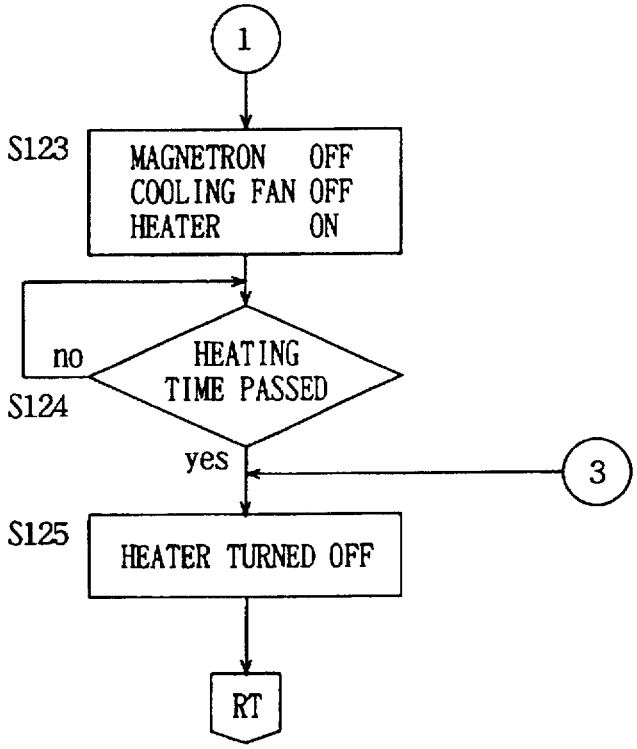
Figure 15:
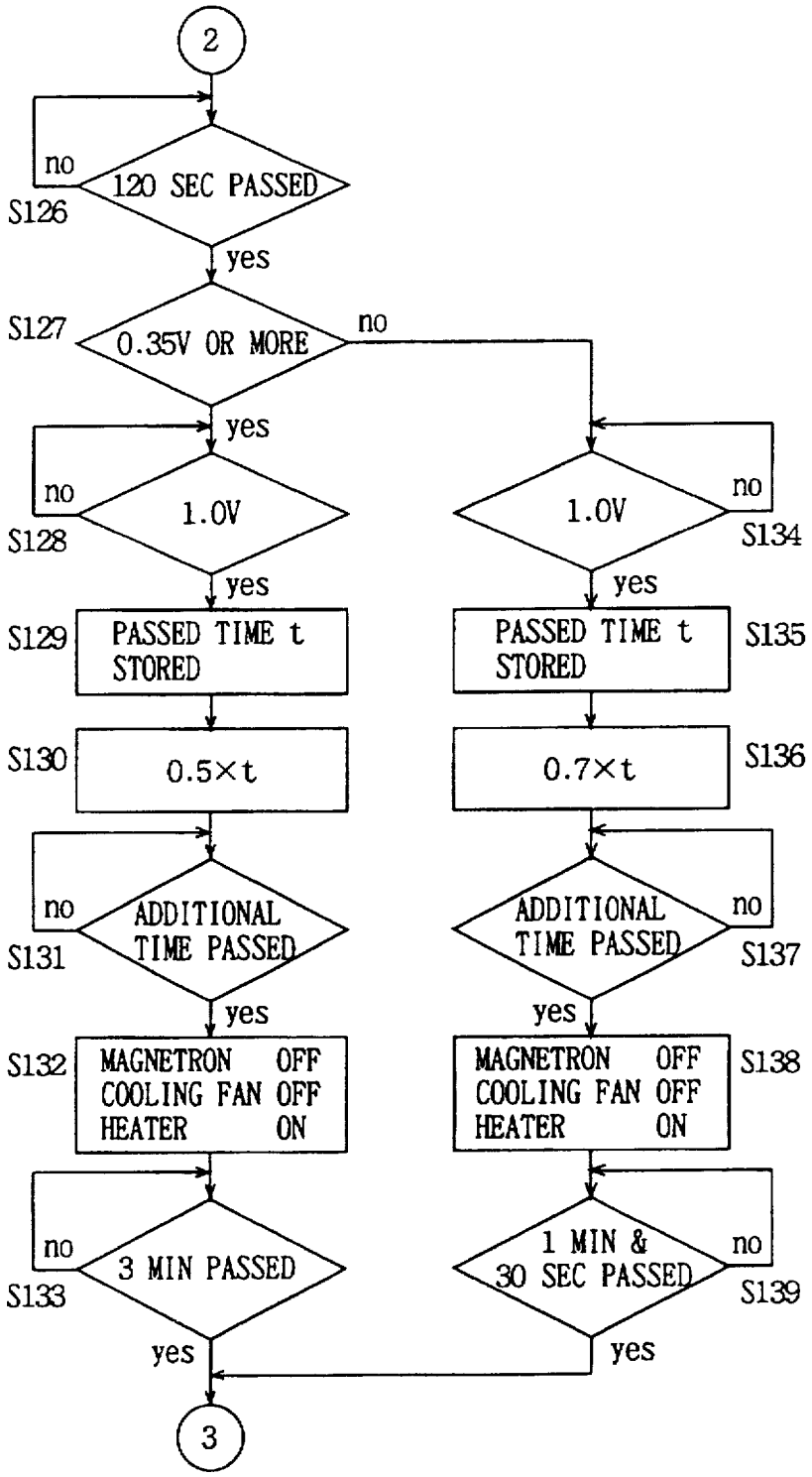

Referring to FIG. 10, the cooking device is provided with a cooking key 38 operated in order to heat frozen precooked food which will be described later. A selection portion 29 is provided to selectively effect a first cooking course execution portion 26 or a second cooking course execution portion 27 based on the amount of humidity change detected by humidity change detection portion 23 for a prescribed time period from the start of heating.

Figure 16:
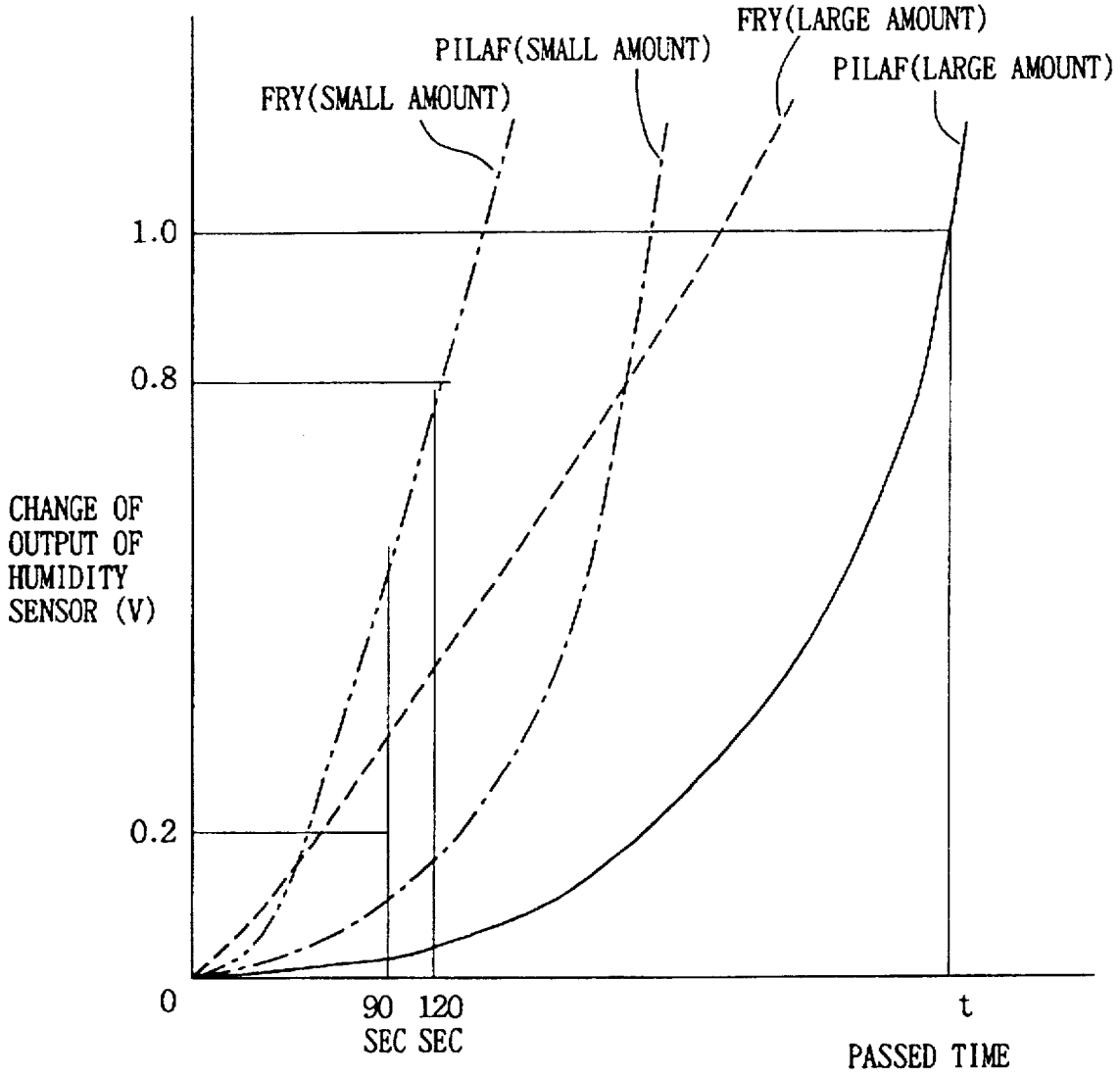
FIG. 16 is a graph showing the relation between the sensor output of the humidity sensor and passage of time.

In this embodiment, as illustrated in FIG. 16, the amount of change of humidity of frozen precooked food such as pilaf is equal to or smaller than 0.2 V 90 seconds after the start of heating regardless of the amount of the food, while the change is equal to or more than 0.2 V for fried food. Detecting the difference in change amounts permits automatic determination of the kind of frozen precooked food, in other words, if it is fried food or pilaf, and cooking appropriate for the food is executed. Note that as for a smaller amount to heat, thawing is quicker, and the humidity changes quickly, while if the amount to heat is large, it takes more time for thawing, and the humidity changes slowly. The energy to heat food is therefore determined taking this into account.

The operation according to this embodiment will be described with reference to the flow charts shown in FIGS.

12 to 15. An initialization operation is executed by setting the cooking flag (denoted as COOKING in FIGS. 12 to 15) and the menu flag (denoted as MENU in FIGS. 12 to 15) to 0 in step S100. In steps S101 to S103, the key operated is determined.

More specifically, it is determined in step S101 if cooking key 28 was operated. If it is determined the key was operated, in step S104, the cooking flag is set to 1. In step S102 it is determined if the automatic menu was selected by cooking selection dial 4. If it is determined that the dial was operated, the menu flag is set to 1 in step S105. It is determined in step S103 if start key 3 was operated. If it is determined that the key was operated, the operation transits to the next step, if it was not operated, the operation returns step S101. Note that if it is determined that no operation was made from step S101 to step S103, the operation transits to the next step.

If it is determined in step S104 that start key 3 was operated, how each flag is set is determined in step S106 or S107 in order to select a method of controlling.

More specifically, it is determined in step S106 if the cooking flag is set to 1. If the cooking flag is set to 1, the frozen food cooking course is executed in step S108. If it is determined that the flag is not set to 1 in step S106, it is then determined in step S107 if the menu flag is set to 1. If the flag is set to 1, a course of heating a cooking menu selected by selection dial 4 is executed in step S109. If it is determined in step S107 that the menu flag is not set to 1, it is determined that only start key 3 was operated, and the warming heating course in step S110 is executed.

If execution of any of the courses according to steps S108 to S110 completes, the operation returns to step S100, and waits until the next operation after executing an initialization operation.

The frozen precooked food cooking course in step S108 as described above will be detailed with reference to FIGS. 13 to 15.

When the operation transits to step S108, in step S111 magnetron 9 and cooling fan 14 are driven. Counting 10 of passage of time from the start of heating is initiated at humidity change counter portion 24 in controller 21. In step S113, the operation waits until humidity counter portion 24 counts 90 seconds.

It is determined in step S114 if the output of humidity sensor 18 has changed by 0.2 V or more by selection portion 29. If it is determined in step S114 that the change of 0.2 V or more was made, the first cooking course for heating fried food in step S115 and on is selected to execute start cooking course execution portion 26. Meanwhile, if it is determined that the change was not 0.2 V or more, the second cooking course for heating pilaf in step S126 and on is selected and the second cooking course execution portion executes the processing. If the first cooking course is selected, the operation waits until the humidity change counter portion 24 counts 120 seconds since the selection was made is step S115. It is determined in step S116 if the amount of humidity change detected by humidity change detection portion 23 for the 120 seconds is 0.3 V or longer. In this step, if the amount to heat fried food is large or small is determined.

If it is determined that the amount is 0.3 V or more in step S116, the amount of heat is determined to be small, and in step S117 the operation waits until the result of the detection by humidity change detection portion 23 becomes 0.8 V or more. In step S118, a time period from the start of heating till humidity change detection portion 23 detects the change amount of 0.8 V or more counted by humidity change counter portion 24 is stored as t in memory 28. In step S119, a heating time period by the heaters is produced by the operation of 0.5×t.

If it is determined in the above step S116 that the change of 0.3 V or more was not made, and that the amount to heat is large, the operation waits until the amount of humidity change output at humidity change detection portion 23 becomes 1.0 V. In step S121, a time period from the start of heating till humidity change detection portion 23 detects the change amount of 1.0 V or more is counted by humidity change counter portion 24 and stored in memory 28. In step S122, a heating time period by the heaters is produced by the operation of 0.4×t.

In step S123 magnetron 9 and cooling fan 14 are turned off, upper heater 10 and lower heater 11 are turned on, and heating by the heaters is executed. It is determined in step S124 if the heating time period by the heaters produced in step S119 or S122 has passed.

If it is determined in step S124 that the heating time period by the heaters has passed, upper heater 10 and lower heater 11 are turned off in step S125, thus completing the heating cooking. The operation returns to step S100, and waits until the next cooking is instructed.

If the second cooking course is selected in step S114, in other words, it is determined that the food to cook is pilaf because the output of humidify change detection portion 23 does not change by 0.2 V or more during the time period of 90 seconds counted, the operation waits until humidity change counter portion 24 counts 120 seconds since the selection in step S126. It is determined in step S127 if the amount of humidity change detected by humidity change detection portion 23 for the 120 seconds is 0.35 V or more. In this step, it is determined if the amount of heat for pilaf is large or small.

If it is determined in step S127 that the amount of humidity change is 0.35 V or more and that the amount of heat is small, in step S128, the operation waits until the result of detection at humidity change detection portion 23 becomes 1.0 V or more. In step S129 the time period form the start of heating until the amount of humidity change detected by humidity change detection portion 23 which is 1.0 V is counted by humidity change counter portion 23 and stored in memory 28. In step 130, an additional operation time period in microwave heating is produced by the operation of 0.5×t.

In step S131, heating by microwaves for the additional operation time period produced in the above step is executed, and then magnetron 9 and cooling fan 14 are stopped in step S132, and then upper heater 10 and lower heater 11 are turned on for switching to heating by the heaters.

In step 133, heating by the heaters is executed for 3 minutes, and the heaters are turned off in step S125.

If it is determined in step S127 that the change of 0.35 V or more was not made, in other words, the amount of heat is large, in step S134 the operation waits until the result of detection by humidity change detection portion 23 becomes 1.0 V or more.

In step 135, the time period from the start of heating started counting by humidity change counter portion 23 till the amount of humidity change detected by humidity change detection portion 23 reaches 1.0 V is stored in memory 28 as t. In step S136, an additional time period for heating by microwaves is produced by the operation of 0.7×t.

In step S137, microwave heating for the additional operation time period produced in the above step is executed, then in step S138 magnetron 9 and cooling fan 14 are stopped, and upper heater 10 and lower heater 11 are turned on, thus switching to heating by the heaters.

In step S139, heating by the heaters is executed for 1 minute and 30 seconds, and then the heaters are turned off in step S125.

Thus, the second cooking course completes, and the operation returns to step S100 and waits until the next cooking is instructed.

As in the foregoing, frozen precooked food such as frozen pilaf and grilled rice balls which are sold at convenience stores are thawed and heated, no such situations is encountered that they are not thawed to the centers during heating by microwaves but thawed during heating by the heaters and moisture in the centers comes onto the surface, damping the finished food. The finished food will be crisp and more tasty according to the present invention.

Note that the heating cooking according to the above-described embodiment is designed to avoid the necessity of wrapping food with film, and therefore the user may enjoy economical advantage as well.

The additional time period operated by additional heating portion 25 in the above-described embodiment is determined based on the initial temperature T0 of heating chamber 7 and time period t2 until humidity change detection portion 23 detects the change of 1.0 V. However, the invention is not limited to the above, and such additional time period may be determined based only on one of initial temperature T0 and time period t2 necessary for humidity change.

INDUSTRIAL APPLICABILITY

As in the foregoing, the cooking device according to the present invention is suitable for thawing and heating food in a large lump such as frozen pilaf or frozen grilled rice balls as those sold at convenience stores.

We claim:

1. A cooking device, comprising:

a heating chamber accommodating food;

microwave heating means for heating the food in said heating chamber by microwaves;

heater heating means for heating the food in said heating chamber using a heater;

a temperature sensor for sensing a temperature in said heating chamber;

a humidity sensor for sensing a humidity in said heating chamber;

control means for making such a control that said food is heated by the heater heating means using the heater after said food is heated by microwaves by said microwave heating means; and counter means for counting a time period from the start of heating till the sensor output of said humidity sensor exhibits a prescribed humidity change, said control means controls said microwave heating means to conduct additional heating before heating by heater heating means by said microwave heating means based on the result of counting by said counter means and the temperature in the heating chamber at the start of heating, sensed by said temperature sensor.

2. The cooking device as recited in claim 1, wherein said control means operates a time period for said additional heating based on the result of counting by said counter means and the temperature of the heating chamber at the start of said heating.

3. The cooking device as recited in claim 2 wherein said food is frozen precooked food.

4. The cooking device as recited in claim 1 wherein said food is frozen precooked food.

5. A cooking device, comprising:

a heating chamber accommodating food;

microwave heating means for heating the food in said heating chamber by microwaves;

heater heating means for heating the food in said heating chamber by a heater;

a temperature sensor for sensing a temperature in said heating chamber;

a humidity sensor for detecting a humidity in said heating chamber;

first cooking course execution means for executing a first cooking course according to which microwave heating by said microwave heating means is executed from the start of heating until the sensor output of said humidity sensor exhibits a prescribed humidity change, and then heater heating by said heater heating means is executed;

second cooking course execution means for executing a second cooking course, wherein additional heating is executed based on the temperature at the start of heating sensed by said temperature sensor and the heating time period from start of heating till the output of said humidity sensor exhibits said prescribed humidity change between the microwave heating and the heater heating in said first cooking course; and selecting means for electing one of said first cooking course and said second cooking course.

6. The cooking device as recited in claim 5, wherein said selecting means selects said first cooking course if the amount of humidity change detected by said humidity sensor after passage of a prescribed time period from the start of heating is larger than a prescribed cooking determination value, and selects said second cooking course if said humidity change amount is smaller than said prescribed cooking determination value.

7. The cooking device as recited in claim 5 wherein said food is frozen precooked food.

8. The cooking device as recited in claim 5, further comprising an operation portion for instructing initiation of cooking and selection of cooking course, wherein said selecting means selects one of said first cooking course and said second cooking course in response to an instruction from said operation portion.

9. The cooking device as recited in claim 8 wherein said food is frozen precooked food.

* * * * *